US011795027B2

(12) United States Patent
Aizono

(10) Patent No.: US 11,795,027 B2
(45) Date of Patent: Oct. 24, 2023

(54) IMAGE FORMING APPARATUS AND IMAGE FORMING SYSTEM

(71) Applicant: CANON KABUSHIKI KAISHA, Tokyo (JP)

(72) Inventor: Keisuke Aizono, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/064,465

(22) Filed: Dec. 12, 2022

(65) Prior Publication Data

US 2023/0183036 A1 Jun. 15, 2023

(30) Foreign Application Priority Data

Dec. 14, 2021 (JP) ..... 2021-202333

(51) Int. Cl.
*B65H 45/04* (2006.01)
*B65H 45/22* (2006.01)
*B65H 7/20* (2006.01)

(52) U.S. Cl.
CPC ..... *B65H 45/223* (2013.01); *B65H 7/20* (2013.01); *B65H 2551/21* (2013.01); *B65H 2557/25* (2013.01); *B65H 2801/03* (2013.01)

(58) Field of Classification Search
CPC ..... B65H 45/18; B65H 45/04; B65H 45/223; B65H 7/20; B65H 37/06
See application file for complete search history.

(56) References Cited

U.S. PATENT DOCUMENTS

2004/0185993 A1* 9/2004 Doi ..... B65H 45/14 493/231
2006/0281620 A1* 12/2006 Hayashi ..... B65H 45/30 493/405
2015/0141230 A1* 5/2015 Maeda ..... B65H 45/147 493/320
2016/0282791 A1* 9/2016 Awano ..... G03G 15/6538
2022/0242084 A1* 8/2022 Kishimoto ..... B65H 45/04

FOREIGN PATENT DOCUMENTS

JP 2004235720 A 8/2004
JP 2011112763 A * 6/2011
JP 2018018188 A * 2/2018
JP 2019064233 A * 4/2019

* cited by examiner

*Primary Examiner* — Patrick H Mackey
(74) *Attorney, Agent, or Firm* — ROSSI, KIMMS & McDOWELL LLP

(57) ABSTRACT

An image forming apparatus includes an image forming unit, an input unit configured to receive input of folding unit information specifying either one of a first sheet folding unit and a second sheet folding unit, and a control unit configured to selectively perform a first mode and a second mode based on the folding unit information, the first mode being a mode in which the image forming unit forms the image on the sheet such that an orientation of the image becomes a first direction, the second mode being a mode in which the image forming unit forms the image on the sheet such that the orientation of the image becomes a second direction inverted from the first direction.

11 Claims, 9 Drawing Sheets

IMAGE FORMING APPARATUS AND IMAGE FORMING SYSTEM

BACKGROUND OF THE INVENTION

Field of the Invention

This disclosure relates to an image forming apparatus forming an image on a sheet and an image forming system including the image forming apparatus.

Description of the Related Art

In multifunction machines, a folder capable of performing a folding process of a sheet is often connected to the multifunction machines. Further, in the multifunction machines, a configuration in which the user can obtain the desired deliverables regardless of an orientation of a document has been proposed (refer to Japanese Patent Laid-Open No. 2004-235720). With this configuration, image data which has been read from the document is rotated, when needed, based on the orientation of the document and the deliverables obtained by folding the sheet in the folder.

As described in Japanese Patent Laid-Open No. 2004-235720, in a case where one single folder is connected to an image forming apparatus as the folder, a folding pattern of the sheet in the folder does not vary. Therefore, in the image forming apparatus described in Japanese Patent Laid-Open No. 2004-235720, it is possible to obtain the deliverables, desired by the user, by folding the sheet in the folder after having rotated the image data in a fixed direction based on an orientation of the read image data. However, in a case where the image forming apparatus is capable of coupling a plurality of types of the folders, whose folding patterns of the sheet are different from each other, there is a problem that, depending on the folders which are connected to the image forming apparatus, it is not possible to obtain the deliverables, desired by the user, only by rotating the image data in the fixed direction based on the orientation of the read image data.

SUMMARY OF THE INVENTION

According to a first aspect of the present invention, an image forming apparatus configured to connect with a first sheet folding unit and a second sheet folding unit, the first sheet folding unit being configured to fold a sheet discharged from the image forming apparatus at a folding position between a middle of the sheet and a first end of the sheet in a sheet discharge direction and then fold the sheet at a folding position between the middle of the sheet and a second end of the sheet opposite to the first end in the sheet discharge direction, the second sheet folding unit being configured to fold a sheet discharged from the image forming apparatus at the folding position between the middle of the sheet and the second end and then fold the sheet at the folding position between the middle of the sheet and the first end, the image forming apparatus includes an image forming unit configured to form an image on the sheet in accordance with image data, an input unit configured to receive input of folding unit information specifying either one of the first sheet folding unit and the second sheet folding unit, and a control unit configured to selectively perform a first mode and a second mode based on the folding unit information, the first mode being a mode in which the image forming unit forms the image on the sheet such that an orientation of the image becomes a first direction, the second mode being a mode in which the image forming unit forms the image on the sheet such that the orientation of the image becomes a second direction inverted from the first direction.

According to a second aspect of the present invention, an image forming apparatus configured to connect with a first sheet folding unit and a second sheet folding unit, the first sheet folding unit being configured to perform a first folding process, the first folding process including a first operation for folding the sheet and a second operation in which the sheet is folded such that a portion of the sheet folded by the second operation overlaps a portion of the sheet folded by the first operation in a thickness direction of the sheet, the second sheet folding unit being configured to perform a second folding process, the second folding process including a third operation for folding the sheet and a fourth operation in which the sheet is folded such that a portion of the sheet folded by the fourth operation overlaps a portion of the sheet folded by the third operation in the thickness direction of the sheet, the image forming apparatus includes an image forming unit configured to form an image on the sheet in accordance with image data, an input unit configured to receive input of folding unit information specifying either one of the first folding process by the first sheet folding unit and the second folding process by the second sheet folding unit, and a control unit configured to control such that the image forming unit changes an orientation of the image formed on the sheet based on the folding unit information which has been input in the input unit.

Further features of the present invention will become apparent from the following description of exemplary embodiments with reference to the attached drawings.

DESCRIPTION OF THE EMBODIMENTS

First Embodiment

Figure 1:
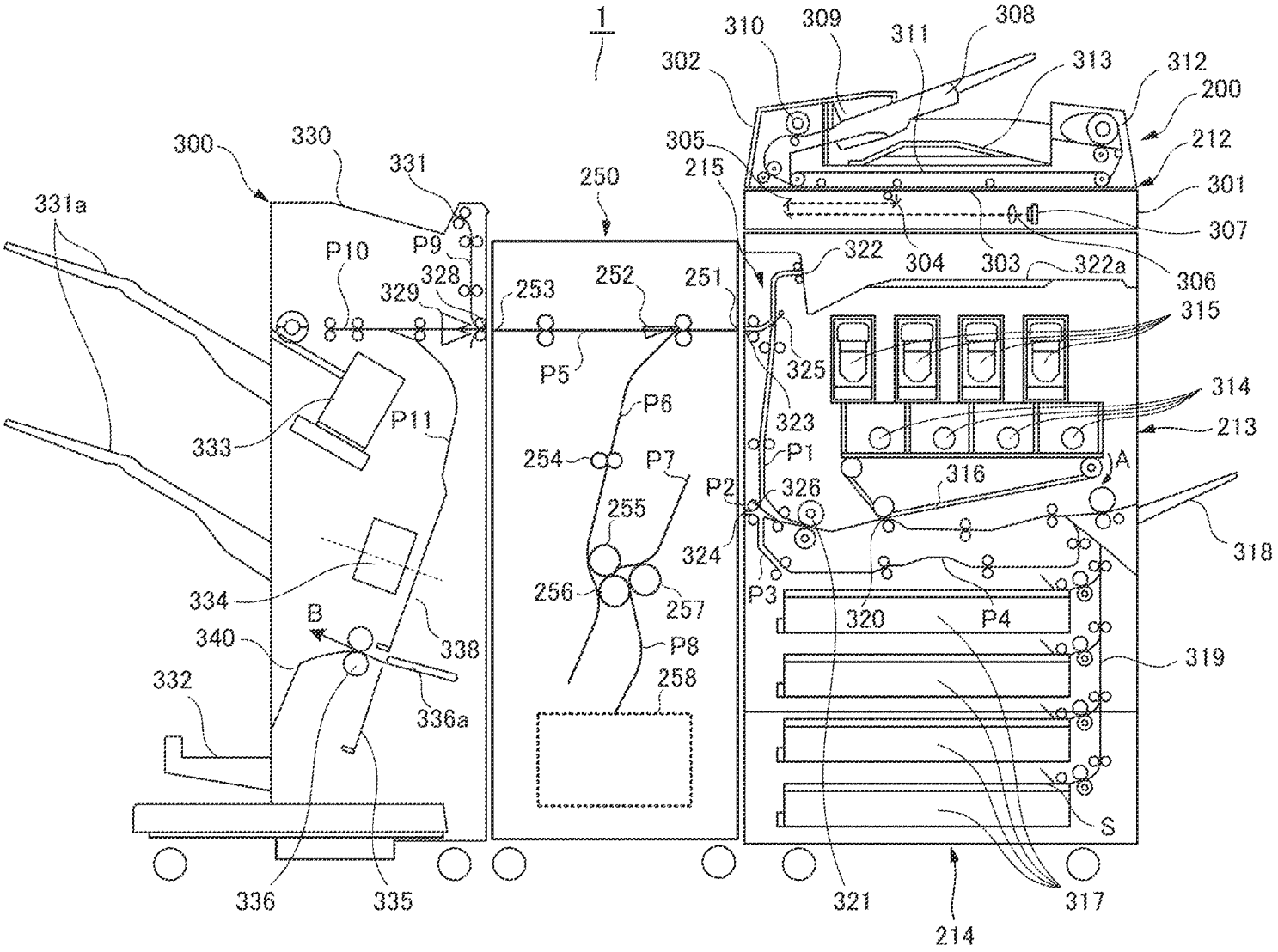
FIG. 1 is a schematic diagram illustrating an image forming system of a first embodiment.

Hereinafter, embodiments of this disclosure will be described in detail with reference to FIGS. 1 to 8. First, a schematic configuration of an image forming system of a first embodiment will be described using FIG. 1. FIG. 1 is cross-sectional views of an image forming apparatus 200, a folding unit 250, serving as a first sheet folding unit, and a saddle unit 300, serving as a second sheet folding unit, included in the image forming system 1.

Image Forming System

As illustrated in FIG. 1, the image forming system 1 includes the image forming apparatus 200 and the folding unit 250 disposed downstream of the image forming apparatus 200 in a sheet conveyance direction. Further, the image forming system 1 includes the saddle unit 300 disposed downstream of the folding unit 250 in the sheet conveyance direction.

The image forming apparatus 200 includes a printer unit 213, serving as an image forming unit for forming an image on a sheet S, and a scanner unit 212, serving as an image reading unit for reading an image from a document.

The scanner unit 212 includes a scanner 301 for optically reading the image from the document and a document feeder (DF) 302 for feeding the document to the scanner 301. In the scanner unit 212, in a case where the image is read by setting the document on a document table 303, after the DF 302 has been opened and the document has been placed on the document table 303, the DF 302 is closed and the image of the document is read. Further, in the scanner unit 212, in a case where the image is read by setting the document on the DF 302, the document is placed on a document setting portion 308 of the DF 302. In the scanner unit 212, when the document is placed on the document setting portion 308 and image reading is started in a state where a document presence/absence sensor 309 detects the document, a document feed roller 310 and a conveyance belt 311 start rotation and convey the document to a predetermined position on the document table 303.

In a case of reading the image of the document, a scanner 301 irradiates the document by a light source 304, and reads the image by a charge coupled device (CCD) 307 via a reflective plate 305 and a lens 306. The CCD 307 converts the read image into a digital signal, and converts the digital signal into image data by performing desired image processing. The converted image data is stored in a hard disk drive (HDD) 112 (refer to FIG. 4) of the image forming apparatus 200. In a case where the image has been read from the document placed on the document setting portion 308 of the DF 302, after the completion of reading the image, the document is conveyed by rotating the conveyance belt 311, and discharged to a document discharge tray 313 via a conveyance roller 312 on a document discharge side. To be noted, in the scanner unit 212, in a case where there are a plurality of documents placed on the document setting portion 308, at the same time when the document is conveyed and discharged from the document table 303, a succeeding document is fed via the document feed roller 310, and the succeeding document is read continuously.

The printer unit 213 is used in a case of printing the image data stored in the HDD 112 (refer to FIG. 4) on the sheet S. The image data is irradiated as recording laser beams of four colors (i.e., yellow, magenta, cyan, and black) onto a photosensitive member 314 of each color, and an electrostatic latent image is formed on the photosensitive member 314 of each color. The printer unit 213 performs toner development with toner supplied from a toner cartridge 315 of each color, and primarily transfers a toner image onto an intermediate transfer belt 316 by superimposing the toner image of each color.

The intermediate transfer belt 316 rotates in an arrow A direction (clockwise rotational direction) in FIG. 1. In the printer unit 213, the sheet S is fed from sheet feeding cassettes 317 or a manual feed tray 318 of a sheet feeding unit 214 to a secondary transfer portion 320 through a sheet conveyance path 319. Then, the superimposed toner image on the intermediate transfer belt 316 is transferred onto a first surface Sa (refer to FIG. 5) of the sheet S by the action of a secondary transfer bias voltage applied to the secondary transfer portion 320.

The sheet S onto which the image has been transferred is heated and pressed in a fixing unit 321 so as to fix the toner image, and conveyed to a sheet discharge unit 215. In a case of simplex printing, the sheet S conveyed to the sheet discharge unit 215 is discharged to one of sheet discharge ports 322, 323, and 324. On the other hand, in a case of duplex printing, a conveyance path of the sheet S conveyed to the sheet discharge unit 215 is switched to a conveyance path P3 by a flapper 326, and the switchbacked sheet S is conveyed to the secondary transfer portion 320 again via a duplex printing conveyance path P4. Then, substantially similarly to the transfer and fixing of the toner image onto and on the first surface Sa of the sheet S, the image is formed on a second surface Sb (refer to FIG. 6), which is the back surface of the first surface Sa of the sheet S.

In a case where the sheet S is discharged from the sheet discharge port 322 or 323, the sheet S is conveyed, by switching a conveyance path by the flapper 326, to a conveyance path P1. Further, in a case where the sheet S is discharged from the sheet discharge port 324, the sheet S is conveyed, by switching a conveyance path by the flapper 326, to a conveyance path P2.

In a case where the sheet S is discharged from the sheet discharge port 322, the sheet S is discharged to a center tray 322*a* disposed above the printer unit 213. In a case where the folding unit 250 is connected to the printer unit 213, the sheet S is discharged from the sheet discharge port 323 to the folding unit 250. Further, in a case where the saddle unit 300 is connected to the printer unit 213, the sheet S is discharged from the sheet discharge port 323 to the folding unit 250. In a case where the printer unit 213 discharges the sheet S from the discharge port 323, the sheet S is conveyed to a position adjacent to the sheet discharge port 322, and, by being switchbacked after a conveyance path has been switched by a flapper 325, is discharged from the sheet discharge port 323.

In a case where the sheet S is discharged from the sheet discharge port 324, the sheet S is discharged to a side tray 324*a* disposed to a side of the printer unit 213. To be noted, the printer unit 213 can discharge the sheet S from the sheet discharge port 324 only in a case where the folding unit 250 or the saddle unit 300 is not attached.

The folding unit 250, serving as the first sheet folding unit, is used for performing a folding process with respect to printed paper, and, in a case where the folding unit 250 is connected to the image forming apparatus 200, the sheet S conveyed from the sheet discharge port 323 is fed from a sheet feed port 251, serving as a first sheet feed port. The folding unit 250 is configured to perform inward tri-folding as the folding process.

In a case where the folding process is not performed in the folding unit 250, the sheet S fed from the sheet feed port 251 is conveyed to a conveyance path P5 by a flapper 252, and discharged from a sheet discharge port 253. On the other hand, in a case where the folding process is performed in the folding unit 250, the sheet S fed from the sheet feed port 251 is conveyed to a conveyance path P6 by the flapper 252.

Figure 2:
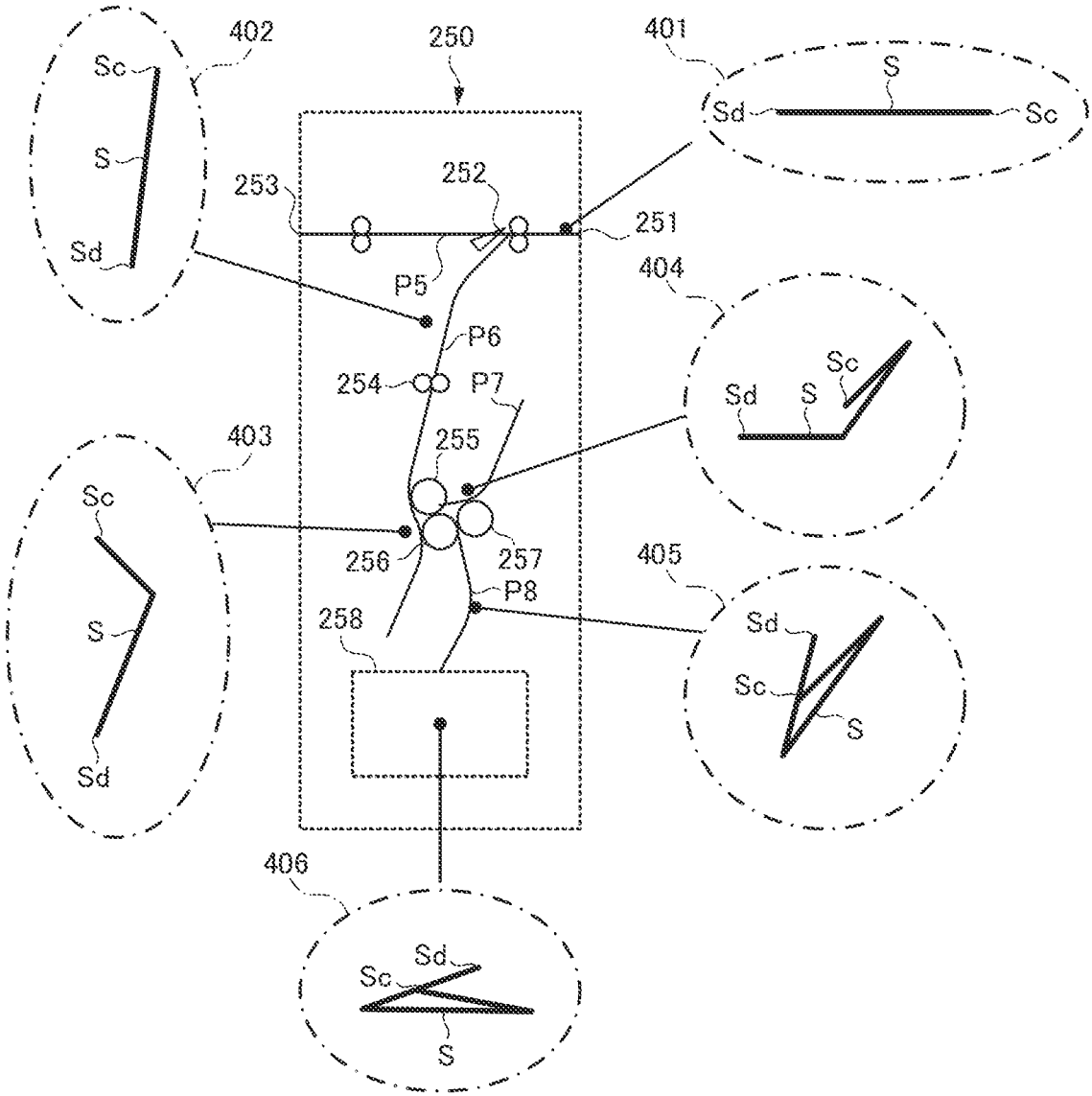
FIG. 2 is a diagram illustrating a shape of a sheet formed in a case where inward tri-folding is performed by a folding unit of the first embodiment.

A case where the inward tri-folding (first inward tri-folding) is performed in the folding unit 250 as the folding process will be described using FIG. 2. FIG. 2 is a diagram illustrating a shape of the sheet S formed in the case where the inward tri-folding is performed in the folding unit 250.

As illustrated in FIG. 2, the sheet S fed from the sheet feed port 251 is conveyed in a shape without a fold line as illustrated in a shape 401, and, in a case where the sheet S is conveyed to the conveyance path P6 and conveyed by a conveyance roller 254, the sheet S is conveyed in the shape without the fold line as shown in a shape 402.

After the sheet S has been conveyed below the conveyance path P6, the sheet S is conveyed to a conveyance path P7 in a manner of being wound by and drawn into folding rollers 255 and 256, and first folding is performed. By the execution of the first folding with the folding rollers 255 and 256, the sheet S is formed in a shape illustrated in a shape 403 in which an end Sc on the upstream side in a sheet feeding direction (feeding direction) at the sheet feed port 251 is folded toward one surface of the sheet S. This end Sc on the upstream side in the sheet feeding direction at the sheet feed port 251 configures an end on one side in the sheet feeding direction at the first sheet feed port of the first embodiment.

After the sheet S has been conveyed to the conveyance path P7, the sheet S is conveyed to a conveyance path P8 in a manner of being wound by and drawn into the folding roller 256 and a folding roller 257, and second folding is performed. By the execution of the second folding with the folding rollers 256 and 257, the sheet S is formed in a shape illustrated in a shape 404 in which an end Sd of the downstream side in the sheet feeding direction at the sheet feed port 251 is folded toward the one surface of the sheet S.

By the execution of the second folding, as illustrated in a shape 405, the end Sd of the sheet S on the downstream side in the sheet feeding direction at the sheet feed port 251 is folded so as to cover the end Sc on the upstream side in the sheet feeding direction at the sheet feed port 251. Then, the sheet S which has been folded twice and inwardly in three is discharged to a sheet discharge portion 258 in a shape illustrated in a shape 406 in which the end Sd faces upward.

The saddle unit 300, serving as the second sheet folding unit, is used for performing post processing with respect to printed paper in accordance with functions which have been specified by the user. In a case where the saddle unit 300 is connected to the image forming apparatus 200, the sheet S conveyed from the discharge port 323 is fed to the saddle unit 300 from a sheet feed port 328, serving as a second sheet feed port. Further, in a case where the saddle unit 300 is connected to the folding unit 250, the sheet S conveyed from the sheet discharge port 253 is fed from the sheet feed port 328 to the saddle unit 300.

In the saddle unit 300, as the post processing, a stapling process using a stapler 333, a shift process for shifting the sheet S from the center of a conveyance path, and a folding process for folding and bundling a plurality of sheets of the sheet S are performed. Further, the saddle unit 300 can perform saddle stitching bookbinding by performing the stapling process in the middle of the sheet S and, further, bi-folding the stapled sheet S in the middle. Further, the saddle unit 300 can fold a sheet of the sheet S.

In a case where the post processing is not performed on the sheet, the sheet S fed from the sheet feed port 328 is conveyed to a conveyance path 9 by a flapper 329, and discharged from a sheet discharge port 331 to a sheet discharge tray 330. On the other hand, in a case where the post processing is performed on the sheet, the sheet S fed from the sheet feed port 328 is conveyed to a conveyance path 10 by the flapper 329.

Figure 3:
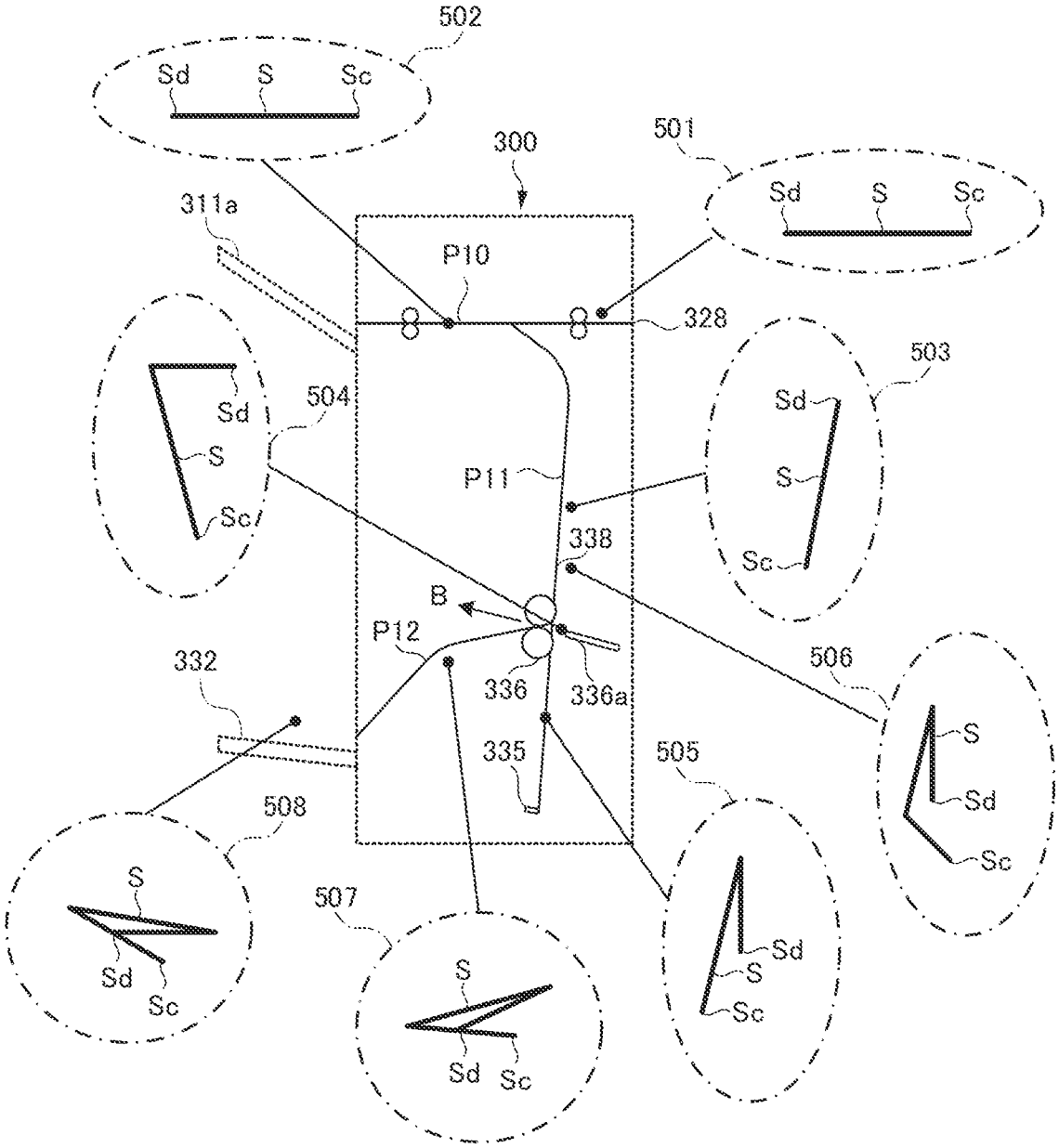
FIG. 3 is a diagram illustrating a shape of the sheet formed in a case where the inward tri-folding is performed by a saddle unit of the first embodiment.

A case of performing the inward tri-folding (second inward tri-folding) in the saddle unit 300 as the folding process will be described using FIG. 3. FIG. 3 is a diagram illustrating a shape of the sheet S formed in the case where the inward tri-folding is performed in the saddle unit 300.

As illustrated in FIG. 3, the sheet S fed from the sheet feed port 328 is conveyed in the shape without the fold line as illustrated in a shape 501, and conveyed to the conveyance path P10 in the shape without the fold line as illustrated in a shape 502. The sheet S conveyed to the conveyance path P10 is switchbacked, and conveyed to a sheet stacking portion 335 in the shape without the fold line as illustrated in a shape 503 via a conveyance path P11. To be noted, in a case where a plurality of sheets are folded inwardly in three and bundled, a corresponding number of sheets of the sheet S for folding inwardly in three and bundling are stacked in the sheet stacking portion 335.

When the sheet S stacked on the sheet stacking portion 335 passes through a nip portion of a folding roller pair 336, the sheet S is projected in an arrow B direction in FIG. 3 by a folding blade 336*a*, so that first folding of the sheet S so as to fold the end Sd is performed. By the execution of the first folding with the folding roller pair 336 and the folding blade 336*a*, the sheet S is formed in a shape illustrated in a shape 504 in which the end Sd on the downstream side in the sheet feeding direction (feeding direction) at the sheet feed port 328 is folded toward one surface of the sheet S. This end Sd on the downstream side in the sheet feeding direction at the sheet feed port 328 configures an end on the other side in the sheet feeding direction at the second sheet feed port of the first embodiment.

After the first folding has been completed, the sheet S is returned to the sheet stacking portion 335 in a shape as illustrated in a shape 505 in which the end Sd is folded. Then, after the sheet S has been returned to a folding position 338, when the sheet S passes through the nip portion of the folding roller pair 336, the sheet S is projected in the arrow B direction in FIG. 3 by the folding blade 336*a*, so that second folding of the sheet S so as to fold the end Sc is performed. By the execution of the second folding with the folding roller pair 336 and the folding blade 336*a*, the sheet S is formed in a shape illustrated in a shape 506 in which the end Sc on the upstream side in the sheet feeding direction (feeding direction) at the sheet feed port 328 is folded toward the one surface of the sheet S.

As illustrated in a shape 507, when the second folding has been performed on the sheet S and the sheet S has been folded inwardly in three, the end Sc on the upstream side in the sheet feeding direction at the sheet feed port 328 is folded so as to cover the end Sd on the downstream side in the sheet feeding direction at the sheet feed port 328. Then, the sheet S which has been folded twice and inwardly in three passes through a conveyance path P12, and is discharged to a sheet discharge tray 332 in an orientation in which the ends of the sheet face the sheet discharge tray 332.

Hardware Configuration

Figure 4:
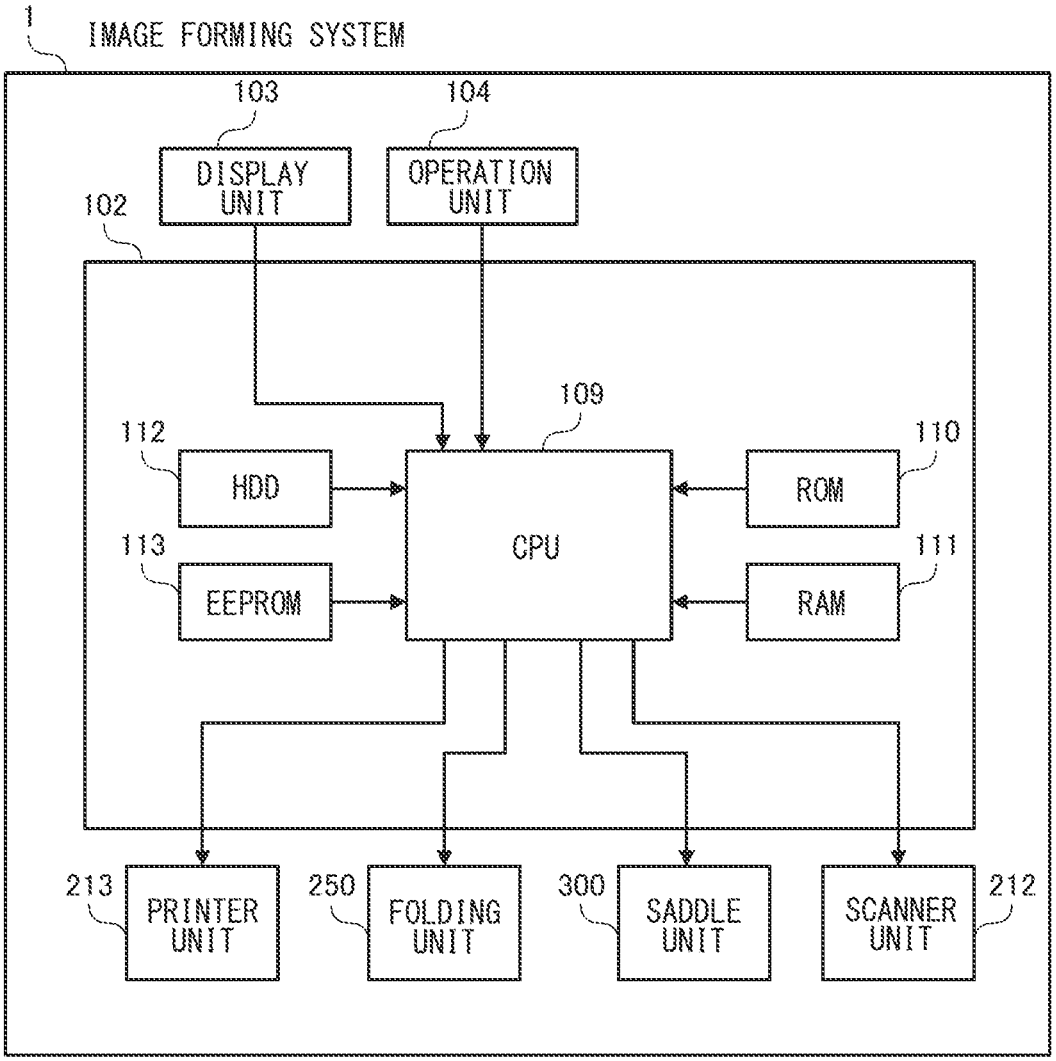
FIG. 4 is a block diagram illustrating a hardware configuration of the image forming system of the first embodiment.

Using FIG. 4, a hardware configuration in the image forming system 1 of the first embodiment will be described. The image forming system 1 includes a controller unit 102, a display unit 103, an operation unit 104, the scanner unit 212, the printer unit 213, the folding unit 250, and the saddle unit 300.

The controller unit 102 includes a central processing unit (CPU) 109, a read only memory (ROM) 110, and a random access memory (RAM) 111. Further, the controller unit 102 includes the HDD 112 and an electrically erasable and programmable read only memory (EEPROM) 113.

The CPU 109 is the central processing unit for controlling each unit and the whole of the image forming system 1, and controls operations of apparatuses connected to the controller unit 102 via each of, such as, interfaces and memories of recording media. The ROM 110 is, for example, a read only memory, and stores such as a boot program required for a system startup. The RAM 111 is a volatile memory, and is a system work memory required at the execution of a control program. Further, the RAM 111 is also a memory for temporarily storing a received job, intermediate data generated for an image forming process, a work area which is an operating area at the time of performing a rendering process, and input image data. The HDD 112 is a record medium such as a magnetic disc, and stores such as system software for various processes, the received job, and the image data. The EEPROM 113 is a nonvolatile memory, and stores such as setting values required at the execution of the control program.

The display unit 103 includes a light emitting diode (LED) and a liquid crystal display, and displays an operation content of the user and the internal information of the apparatus. The operation unit 104 receives an operation from the user, and includes an operation button. To be noted, it is acceptable to integrate the operation unit 104 with the display unit 103 by including a touch display in operation unit 104, The scanner unit 212 generates the image in a raster format from a sheet of paper which has been read. The generated image is sent to the printer unit 213, the RAM 111, or the HDD 112. The printer unit 213 receives print instructions from the CPU 109, and forms an image on the sheet S (paper) in accordance with the image data sent from the CPU 109. The folding unit 250 performs the folding process such as the inward tri-folding described above with respect to the sheet which has been output by the printer unit 213. The saddle unit 300 performs the post processing such as the inward tri-folding described above, a sorting process, and the stapling process with respect to the sheet which has been output by the printer unit 213.

Inward Tri-Folding

Figure 5A:
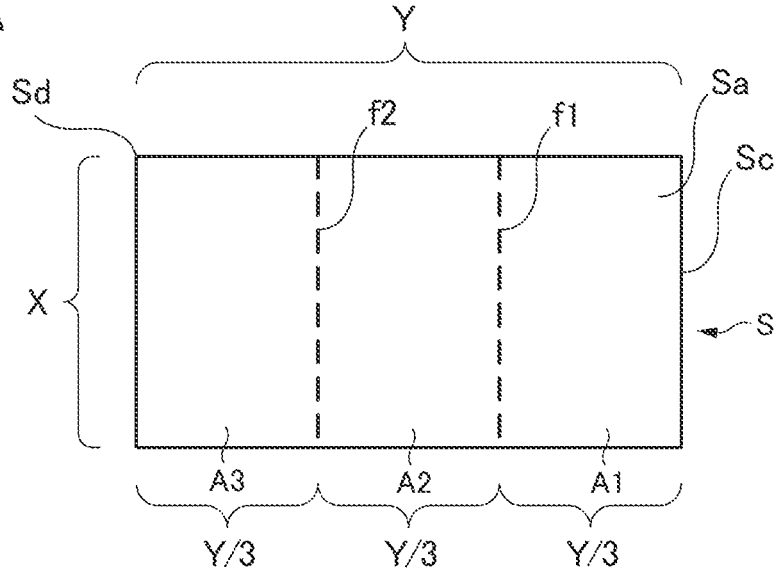
FIG. 5A is a diagram illustrating the sheet in a state prior to being folded inwardly in three in the image forming system of the first embodiment.

Regarding the inward tri-folding performed by the folding unit 250 and the saddle unit 300, the inward tri-folding performed by the folding unit 250 will be described, as an example, using FIGS. 5A to 5C. FIG. 5A is a diagram illustrating the sheet S in a state prior to being folded inwardly in three, FIG. 5B is a diagram illustrating the sheet S in a state where the first folding has been performed in the folding unit 250, and FIG. 5C is a diagram illustrating the sheet S in a state where the second folding has been performed in the folding unit 250 and the sheet S has been folded inwardly in three.

With respect a short side X in a short direction of the sheet S and a long side Yin a longitudinal direction, a fold line f1 and a fold line f2 are lines which divide the long side Y into substantially three equal parts. The folding unit 250 folds the sheet S along the fold lines f1 and f2 such that, in each folding, one surface is folded so as to be positioned to the inside. By the inward tri-folding, the sheet S is divided into an area A1 between the end Sc on the upstream side in the sheet feeding direction at the sheet feed port 251 and the fold line f1, an area A2 between the fold lines f1 and f2, and an area A3 between the end Sd on the downstream side in the sheet feeding direction at the sheet feed port 251 and the fold line f2. The length of each of the areas A1 to A3 in the longitudinal direction is one third of Y.

The folding unit 250 folds the end Sc of the sheet S along the fold line f1 as the first folding so as to position a first surface Sa to the inside. Thereby, the shape of the sheet S becomes a shape as illustrated in FIG. 5B in which the length in the longitudinal direction is two third of Y. Then, the folding unit 250 folds the end Sd of the sheet S along the fold line f2 as the second folding so as to position the first surface Sa to the inside. Thereby, the shape of the sheet S becomes a shape as illustrated in FIG. 5C in which the length in the longitudinal direction is one third of Y, and the sheet S is brought into a state of being folded inwardly in three.

Figure 5B:
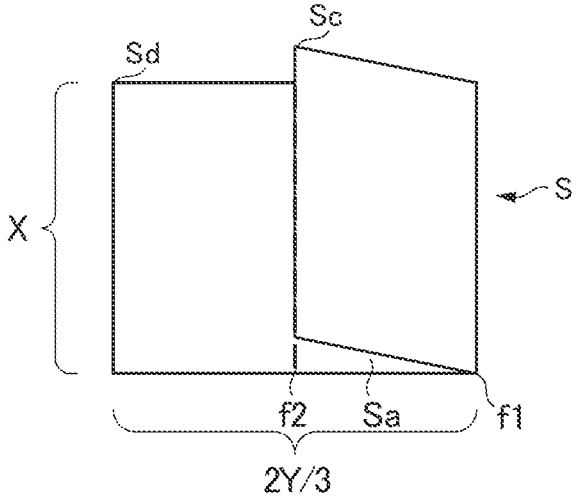
FIG. 5B is a diagram illustrating the sheet on which first folding has been performed in the folder unit.
Figure 5C:
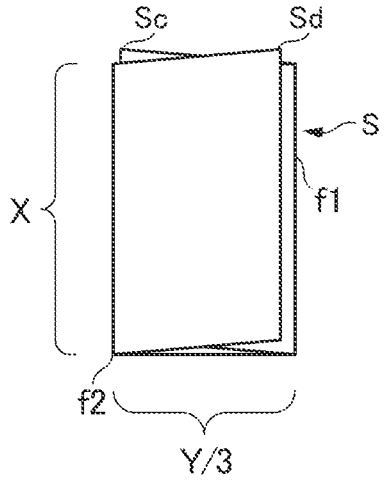
FIG. 5C is a diagram illustrating the sheet on which second folding has been performed in the folding unit so as to fold the sheet inwardly in three.

To be noted, while, in FIGS. 5A to 5C, the inward tri-folding by the folding unit 250 is described as an example, in the inward tri-folding by the saddle unit 300, the end Sd is folded along the fold line f2 as the first folding so as to position the first surface Sa to the inside. Further, in the inward tri-folding by the saddle unit 300, the end Sc is folded along the fold line f1 as the second folding so as to position the first surface Sa to the inside.

Difference Between Deliverables of Folding Unit and Deliverables of Saddle Unit

Next, using FIGS. 6A and 6B, details of deliverables generated by performing the inward tri-folding of the sheet S in the folding unit 250 and deliverables generated by performing the inward tri-folding of the sheet S in the saddle unit 300 will be described.

Figure 6A:
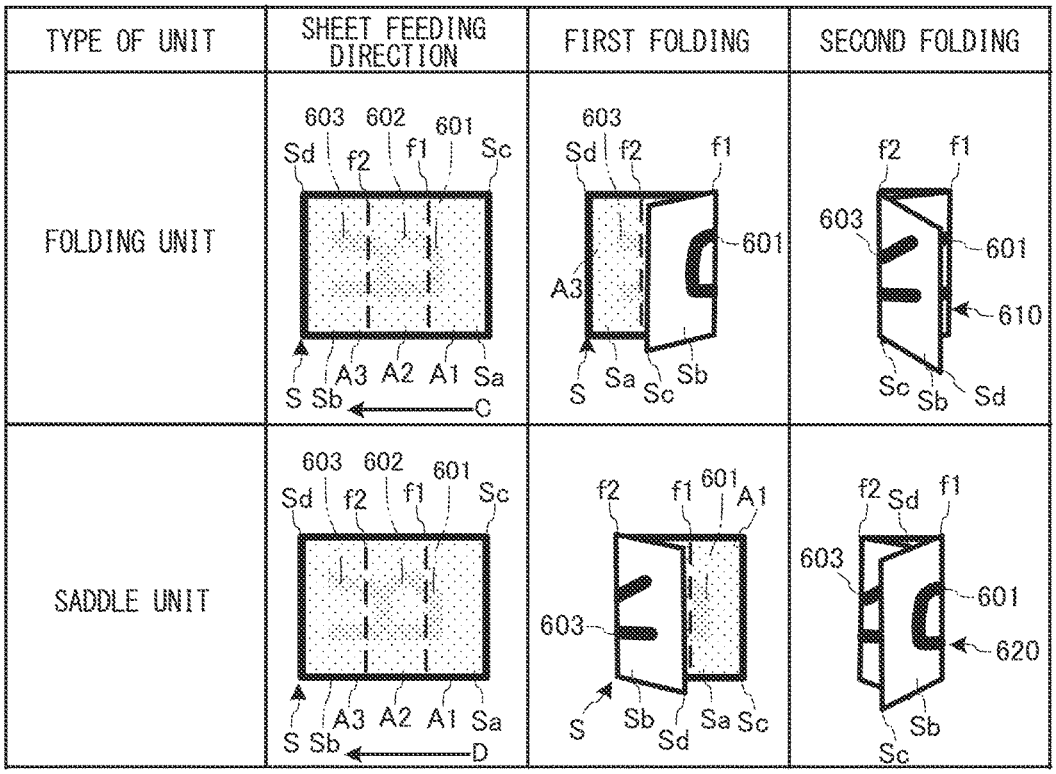
FIG. 6A is a diagram illustrating a deliverable which is generated by performing the inward tri-folding in each unit in a case where an image has been formed on the sheet in the image forming system of the first embodiment without converting the image data read from the document.
Figure 6B:
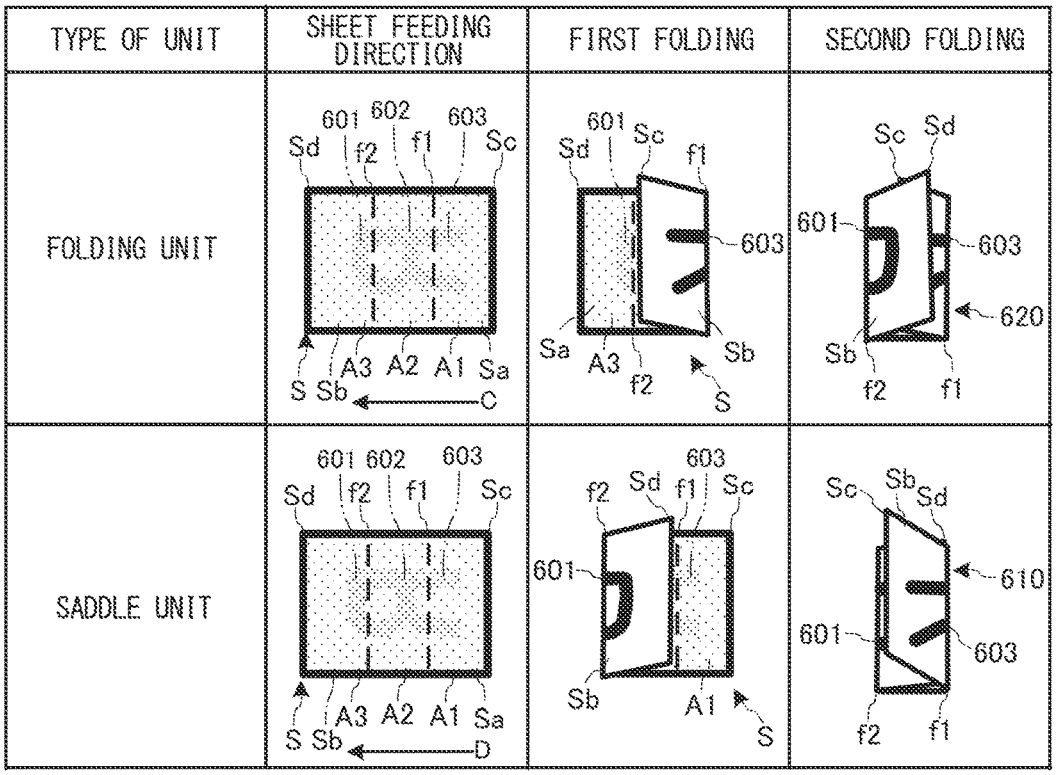
FIG. 6B is a diagram illustrating a deliverable which are generated by performing the inward tri-folding in each unit in a case where the image has been formed on the sheet in the image forming system of the first embodiment by inverting (rotating by 180 degrees) the image data read from the document.

FIGS. 6A and 6B are diagrams illustrating orientations of the sheet at the sheet feed ports, states where the first folding of the inward tri-folding has been performed, and states where the second folding of the inward tri-folding has been performed. In examples illustrated in FIGS. 6A and 6B, on the sheet S which is folded inwardly in three so as to position the first surface Sa to the inside, the image is formed on the second surface Sb which is on the back of the first surface Sa.

The image illustrated in FIGS. 6A and 6B includes an image 601 formed in the area A1 between the end Sc and the fold line f1, an image 602 formed in the area A2 between the fold lines f1 and f2, and an image 603 formed in the area A3 between the end Sd and the fold line f2. Further, the images 601 and 603 are images different from each other. In the image in accordance with the image data, the images 601, 602, and 603 respectively configure a first, second, and third portion.

FIG. 6A is a diagram illustrating deliverables which are generated by performing the inward tri-folding of the sheet in the respective units in a case where the image has been formed on the sheet without converting the image data read from the document. Further, FIG. 6B is a diagram illustrating deliverables which are generated by performing the inward tri-folding of the sheet in the respective units in a case where the image has been formed on the sheet by inverting (rotating by 180 degrees) the image data read from the document.

To be noted, in the description described below, the image 601 serves as an image positioned on an upper side in a case where the longitudinal direction of the sheet is treated as an upper/lower direction, and the image 603 serves as an image positioned on a lower side in the case where the longitudinal direction of the sheet is treated as the upper/lower direction.

As described above, in the sheet S which is folded inwardly in three in the folding unit 250, first, the end Sc on the upstream side in the sheet feeding direction C at the sheet feed port 251 is folded along the fold line f1, and, then, the end Sd on the downstream side in the sheet feeding direction C is folded along the fold line f2. Further, as described above, in the sheet S which is folded inwardly in three in the saddle unit 300, first, the end Sd on the downstream side in the sheet feeding direction D at the sheet feed port 328 is folded along the fold line f2, and, then, the end Sc on the upstream side in the sheet feeding direction D is folded along the fold line f1.

Therefore, as illustrated in FIG. 6A, in a case where the sheet S on which the image 601 has been formed in the area A1 is folded inwardly in three by the folding unit 250, a deliverable 610 which is folded inwardly in three so as to position the image 601 to the inside of the image 603 is generated. Further, in a case where the sheet S on which the image 601 has been formed in the area A1 is folded inwardly in three by the saddle unit 300, a deliverable 620 which is folded inwardly in three so as to position the image 603 to the inside of the image 601 is generated.

On the other hand, as illustrated in FIG. 6B, in a case where the sheet S on which the image 601 has been formed in the area A3 is folded inwardly in three by the folding unit 250, a deliverable 620 which is folded inwardly in three so as to position the image 603 to the inside of the image 601 is generated. Further, in a case where the sheet S on which the image 601 has been formed in the area A3 is folded inwardly in three by the saddle unit 300, the deliverable 610 which is folded inwardly in three so as to position the image 601 to the inside of the image 603 is generated.

Therefore, in the image forming system 1, it is necessary to invert (rotate by 180 degree) an orientation of the image formed on the sheet so as to obtain the same deliverables in the case of folding the sheet inwardly in three by the folding unit 250 and in the case of folding the sheet inwardly in three by the saddle unit 300.

Operation Unit

A touch display 104*a*, which is a type of the operation unit 104 and in which the operation unit 104 is integrated with the display unit 103, will be described using FIG. 7. The operation unit 104 of the first embodiment includes, separate from the touch display 104*a*, a copy start button which the user operates so as to start a copy. By performing the copy, the image is read from the document, and then the image is formed on the sheet. To be noted, it is acceptable to configure the operation unit 104 such that the touch display 104*a* includes the copy start button.

Figure 7A:
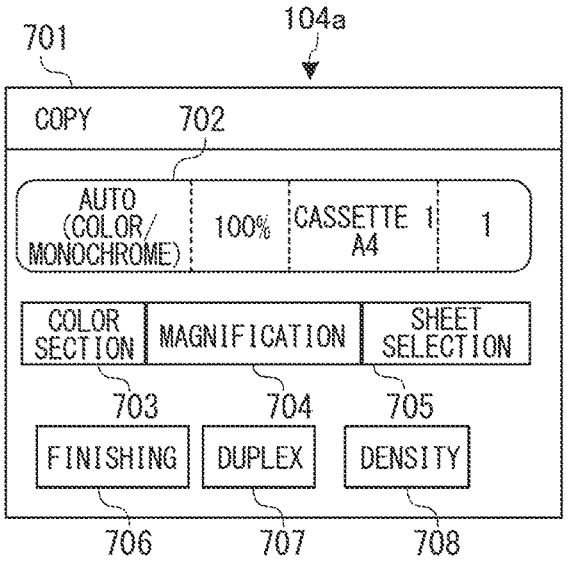
FIG. 7A is a diagram illustrating a copy screen displayed in an operation unit of the first embodiment.

FIG. 7A is a diagram illustrating a copy screen 701 which is the top screen of a copy function displayed on the operation unit 104. As illustrated in FIG. 7A, the copy screen 701 displays a setting display 702 illustrating currently set contents and a color selection button 703 used for specifying the color selection of printed matter. Further, the copy screen 701 displays a magnification button 704 used for specifying a magnification of the printed matter with respect to the document and a sheet selection button 705 used for specifying from where the sheet to be printed is fed. Further, the copy screen 701 displays a finishing button 706 used for specifying a finish of the printed matter and a duplex button 707 used for specifying whether the duplex printing is performed on the printed matter. Then, the copy screen 701 displays a density button 708 used for specifying density at the time of printing the printed matter.

Numeric input and displays of choices, to the extent available in the image forming apparatus 200, are performed in detail setting screens for the color selection button 703, the magnification button 704, the sheet selection button 705, the finishing button 706, the duplex button 707, and the density button 708. To be noted, it is acceptable to dispose setting buttons other than the buttons described above in the copy screen 701.

Figure 7C:
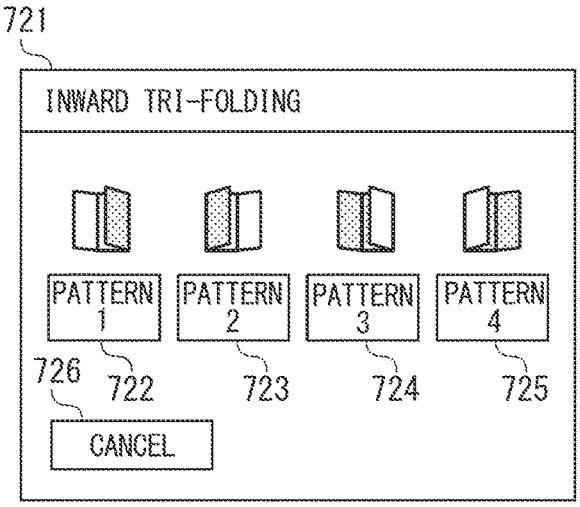
FIG. 7C is a diagram illustrating an inward tri-folding screen displayed in the operation unit.
Figure 7B:
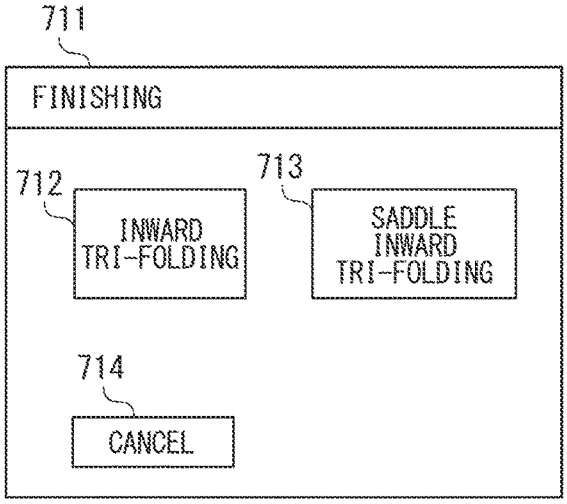
FIG. 7B is a diagram illustrating a finishing screen displayed in the operation unit.

FIG. 7B is a diagram illustrating a finishing screen 711 which is displayed by operating the finishing button 706. As illustrated in FIG. 7B, an inward tri-folding button 712 used for specifying the inward tri-folding of the sheet by the folding unit 250 is displayed in the finishing screen 711. Further, a saddle inward tri-folding button 713 used for specifying the inward tri-folding of the sheet by the saddle unit 300 is displayed in the finishing screen 711. Further, a cancel button 714 used in a case of cancelling a finish setting is displayed in the finishing screen 711.

FIG. 7C is a diagram illustrating an inward tri-folding screen 721 which is displayed by operating the inward tri-folding button 712. As illustrated in FIG. 7C, a pattern 1 button 722 to a pattern 4 button 725 used for specifying a folding pattern of the sheet which is folded inwardly in three are displayed in the inward tri-folding screen 721. The folding pattern corresponds to the orientation of the image on the sheet and a surface on which the image is formed. Further, a cancel button 726 used in a case of cancelling the finish setting is displayed in the inward tri-folding screen 721.

The pattern 1 specified by operating the pattern 1 button 722 and patterns 2 specified by operating pattern 2 button 723 are patterns in which the printed surface is visible in a state where the sheet is folded inwardly in three, that is, the printed surface is positioned to the outside of the sheet.

The pattern 3 specified by operating the pattern 3 button 724 and patterns 4 specified by operating pattern 4 button 725 are patterns in which the printed surface is not visible in a state where the sheet is folded inwardly in three, that is, the printed surface is positioned to the inside of the sheet.

Further, as indicated by the deliverable 610 illustrated in FIGS. 6A and 6B, the patterns 1 and 3 are patterns in which the inward tri-folding is performed such that the sheet is first folded between the images 601 and 602 and then folded between images 602 and 603.

Further, as indicated by the deliverable 620 illustrated in FIGS. 6A and 6B, the patterns 2 and 4 are patterns in which the inward tri-folding is performed such that the sheet is first folded between the images 602 and 603 and then folded between images 601 and 602.

In a case where one of the patterns 1 to 4 is specified from the inward tri-folding screen 721, as information of a unit (unit information) which performs the inward tri-folding, the CPU 109 stores the unit information specifying the folding unit 250 in the HDD 112 by inclusion in setting information. Further, in a case where one of the patterns 1 to 4 is specified, the CPU 109 stores the information of the specified pattern (pattern information) in the HDD 112 by inclusion in the setting information.

Figure 7D:
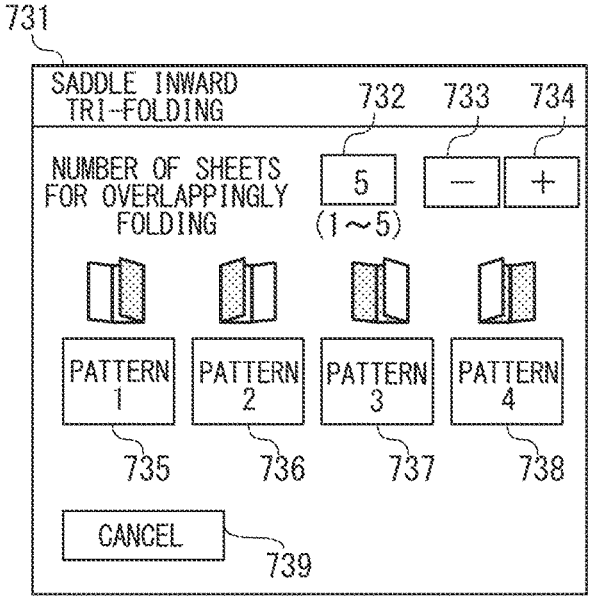
FIG. 7D is a diagram illustrating a saddle inward tri-folding screen displayed in the operation unit.

FIG. 7D is a diagram illustrating a saddle inward tri-folding screen 731 which is displayed by operating the saddle inward tri-folding button 713. As illustrated in FIG. 7D, an overlappingly folding number display 732 displaying a number (number of sheets of overlappingly folding) of sheets which are bundled by being folded inwardly in three is displayed in the saddle inward tri-folding screen 731. Further, a minus button 733 used for decreasing the number of sheets of the overlappingly folding and a plus button 734 used for increasing the number of sheets of the overlappingly folding are displayed in the saddle inward tri-folding screen 731. Further, a pattern 1 button 735 to a pattern 4 button 738 used for specifying a pattern of folding the sheet which is folded inwardly in three are displayed in the saddle inward tri-folding screen 731. The pattern corresponds to the orientation of the image on the sheet and the surface on which the image is formed. Further, a cancel button 739 used in a case of cancelling the finish setting is displayed in the saddle inward tri-folding screen 731.

The saddle unit 300 of the first embodiment can bundle one to five sheets by folding the sheets inwardly in three. Therefore, it is possible to specify a range of one to five in the saddle inward tri-folding screen 731 as the number of sheets of the overlappingly folding. In a case where five is set as the number of sheets of the overlappingly folding, an operation of the plus button 734 is disabled. Further, in a case where one is set as the number of sheets of the overlappingly folding, an operation of the minus button 733 is disabled.

The patterns 1 to 4 specified by operating the button in the saddle inward tri-folding screen 731 are similar to the patterns 1 to 4 which are specified by operating the pattern 1 button 722 to the pattern 4 button 725 in the inward tri-folding screen 721.

In a case where one of the patterns 1 to 4 is specified from the saddle inward tri-folding screen 731, as the unit information for performing the inward tri-folding, the CPU 109 stores the unit information specifying the saddle unit 300 in the HDD 112 by inclusion in the setting information. Further, in a case where one of the patterns 1 to 4 is specified, the CPU 109 stores the information of the specified pattern (pattern information) in the HDD 112 by inclusion in the setting information.

This unit information which specifies either the folding unit 250 or the saddle unit 300 configures folding unit information in the first embodiment. Further, the pattern information which specifies one of the patterns 1 to 4 as the folding pattern of the sheet configures folding information in the first embodiment. Further, the pattern information which specifies the patterns 1 and 3 configures first folding information in the first embodiment, and the pattern information which specifies the patterns 2 and 4 configures second folding information in the first embodiment. Further, the operation unit 104 which enables the input of the unit information and the pattern information configures an input unit in the first embodiment.

The controller unit 102 performs screen displays illustrated in FIGS. 7A to 7D in the display unit 103, and receives print settings which the user inputs via an operation of the operation unit 104.

Image Forming Process in Case of Performing Inward Tri-Folding

Figure 8:
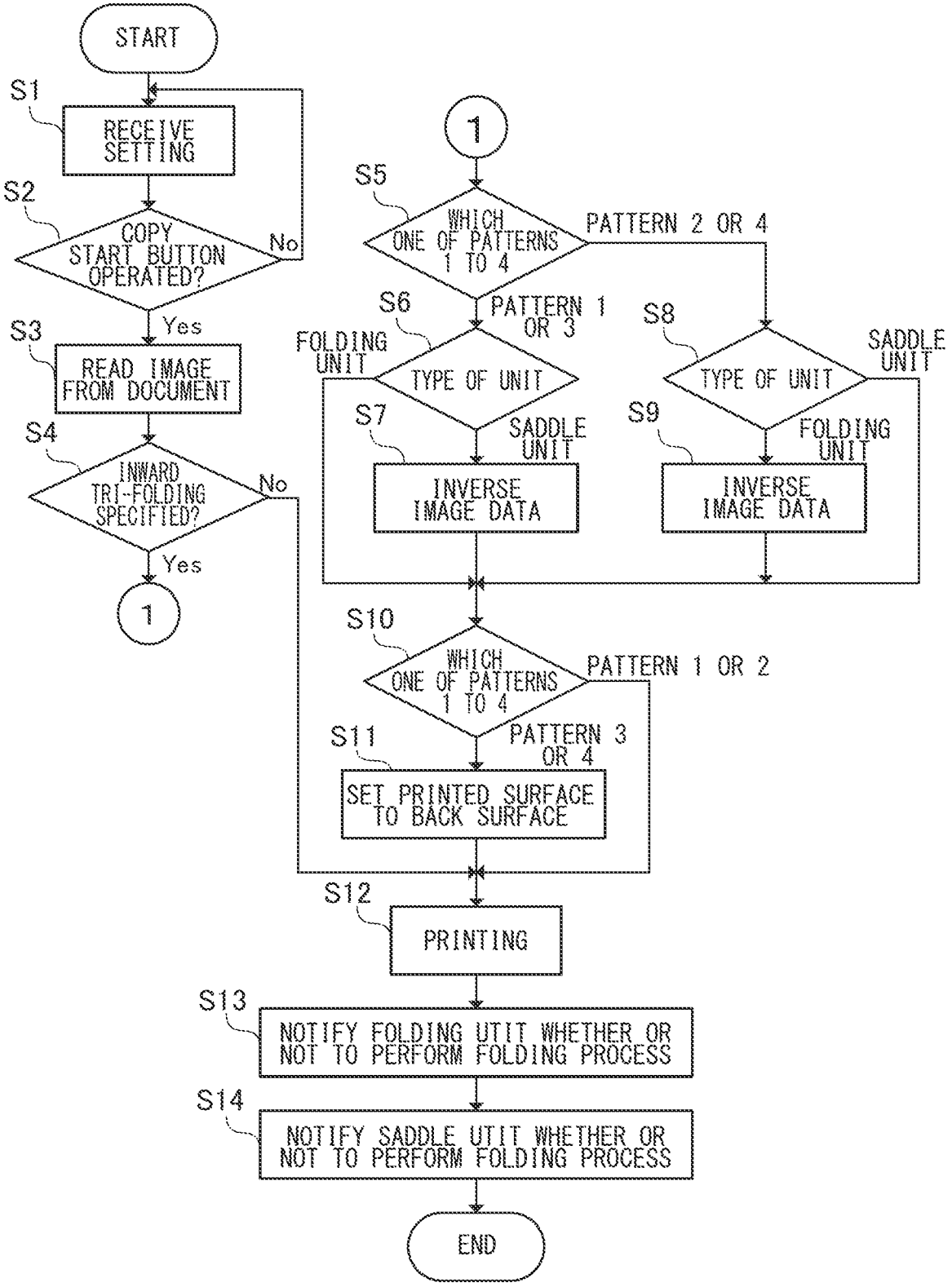
FIG. 8 is a flowchart illustrating an image forming process executed in a case where the inward tri-folding is performed in the image forming system of the first embodiment.

FIG. 8 is a flowchart illustrating the image forming process in a case where the CPU 109 of the controller unit 102 of the image forming apparatus 200 of the first embodiment performs the inward tri-folding. The CPU 109 achieves the control process illustrated in FIG. 8 by executing the control program.

First, the CPU 109 receives a setting of the copy function via the operation unit 104 (STEP 51). In this process, in a case where each of the buttons disposed in the touch display 104*a* is operated by the user, the CPU 109 stores the content of the operation in the HDD 112 as the setting information. Next, the CPU 109 judges whether or not the copy start button is operated by the user (STEP S2). In this process, in a case where it is judged that the copy start button is not operated (STEP S2: NO), the CPU 109 proceeds with the process to STEP 51.

On the other hand, in a case where it is judged that the copy start button is operated (STEP S2: YES), the CPU 109 reads the image from the document (STEP S3). In this process, in a case where the document is set on the document setting portion 308 of the DF 302, the CPU 109 conveys the set document to a predetermined position on the document table 303, and performs the reading of the image and the conversion into the image data by the scanner 301. Further, in a case where the document is placed on the document table 303, the CPU 109 performs the reading of the image from the placed document and the conversion into the image data by the scanner 301. The CPU 109 stores the image data, which is read and converted by the scanner unit 212, in the HDD 112.

Next, the CPU 109 judges whether or not the inward tri-folding is specified (STEP S4). In this process, the CPU 109 judges from the setting information stored in the HDD 112 whether or not the user has operated the inward tri-folding screen 721 or the saddle inward tri-folding screen 731 and specified the execution of the inward tri-folding.

In a case where it is judged in the process of STEP S4 that the execution of the inward tri-folding is not specified (STEP S4: NO), the CPU 109 proceeds with the process to STEP S12. On the other hand, in a case where it is judged in the process of STEP S4 that the execution of the inward tri-folding is specified (STEP S4: YES), the CPU 109 judges which one of the patterns 1 to 4 is specified for the folding pattern (STEP S5). In this process, from the pattern information included in the setting information, the CPU 109 judges which one of the patterns 1 to 4 is specified by the user.

In a case where the CPU 109 judges that the pattern 1 or 3 is specified, the CPU 109 proceeds with the process to STEP S6. The pattern 1 and 3 are patterns in which the inward tri-folding is performed such that an end on which the image 601 on the upper side has been formed is covered by an end on which the image 603 on the lower side has been formed. On the other hand, in a case where the CPU 109 judges that the pattern 2 or 4 is specified, the CPU 109 proceeds with the process to STEP S8. The pattern 2 and 4 are patterns in which the inward tri-folding is performed such that the end on which the image 603 on the lower side has been formed is covered by the end on which the image 601 on the upper side has been formed.

In a case where it is judged in the process of STEP S5 that the pattern 1 or 3 is specified, the CPU 109 judges the type of specified unit (STEP S6). In this process, from the unit information included in the setting information, the CPU 109 judges which one of the folding unit 250 and the saddle unit 300 has been specified by the user.

As illustrated in FIG. 6A, in a case where the image forming apparatus 200 has formed the image without converting the image data, the image 601 on the upper side is formed in the area A1 between the end Sc on the upstream side in the sheet feeding direction at the sheet feed port 251 of the folding unit 250 and the fold line f1. Further, the image forming apparatus 200 forms the image 603 on the lower side in the area A3 between the end Sd on the downstream side in the sheet feeding direction at the sheet feed port 251 of the folding unit 250 and the fold line f2. Then, the folding unit 250 performs the inward tri-folding by first folding the end Sc along the fold line f1 and then folding the end Sd along the fold line f2.

That is, in a case where the pattern 1 or 3 is specified and the inward tri-folding is performed by the folding unit 250, the image forming system 1 can generate the deliverables, desired by the user, by forming the image on the sheet without converting the image data. Since the CPU 109 outputs the read image data directly without conversion, the CPU 109 proceeds with the process to STEP S10 by skipping the process of STEP S7.

On the other hand, in a case where the image forming apparatus 200 has formed the image without converting the image data, the image 601 on the upper side is formed in the area A1 between the end Sc on the upstream side in the sheet feeding direction at the sheet feed port 328 of the saddle unit 300 and the fold line f1. Further, the image forming apparatus 200 forms the image 603 on the lower side in the area A3 between the end Sd on the downstream side in the sheet feeding direction at the sheet feed port 328 of the saddle unit 300 and the fold line f2.

As described above, the saddle unit 300 performs the inward tri-folding by first folding the end Sd along the fold line f2 and then folding the end Sc along the fold line f1. Therefore, in a case where the pattern 1 or 3 is specified and the saddle unit 300 performs the inward tri-folding, the image forming apparatus 200 can generate the deliverables, desired by the user, by inverting the image data as illustrated in FIG. 6B and forming the image on the sheet. Therefore, the CPU 109 proceeds with the process to STEP S7 so as to invert the image data.

In a case where it is judged in the process of STEP S6 that the inward tri-folding in the saddle unit 300 is specified, the CPU 109 inverts (rotate by 180 degrees) the image data (STEP S7). In this process, the CPU 109 inverts the image data stored in the HDD 112 by performing the rotation of 180 degrees with respect to the center point of the upper/lower direction and a left/right direction.

In a case where it is judged in the process of STEP S5 that the pattern 2 or 4 is specified, the CPU 109 judges the type of specified unit (STEP S8). In this process, substantially similarly to the process of STEP S6, from the unit information included in the setting information, the CPU 109 judges which one of the folding unit 250 and the saddle unit 300 has been specified by the user.

As illustrated in FIG. 6A, in a case where the pattern 2 or 4 is specified and the sheet is folded inwardly in three in the saddle unit 300, the image forming system 1 can generate the deliverables, desired by the user, by forming the image on the sheet without converting the image data. Since the CPU 109 outputs the read image data directly without conversion, the CPU 109 proceeds with the process to STEP S10 by skipping the process of STEP S9.

On the other hand, in a case where the pattern 2 or 4 is specified and the sheet is folded inwardly in three in the folding unit 250, the image forming apparatus 200 can generate the deliverables, desired by the user, by inverting the image data as illustrated in FIG. 6B and forming the image on the sheet. Therefore, the CPU 109 proceeds with the process to STEP S9 so as to invert the image data.

In a case where it is judged in the process of STEP S8 that the inward tri-folding in the folding unit 250 is specified, the CPU 109 inverts (rotate by 180 degrees) the image data (STEP S9). In this process, substantially similarly to the process of STEP S7, the CPU 109 inverts the image data stored in the HDD 112 by performing the rotation of 180 degrees with respect to the center point of the upper/lower direction and the left/right direction.

By proceeding with the process directly from STEPS S6 and S8 to STEP S10, based on the unit information and the pattern information, the CPU 109 can output the sheet such that the orientation of the image becomes the same direction as the orientation of the image data.

Further, by proceeding with the process from STEPS S6 and S8 to STEPS S7 and S9, the CPU 109 can output the sheet, based on the unit information and the pattern information, such that the orientation of the image becomes a direction inverted from the orientation of the image data.

After the execution of the process of STEP S7 or S9, the CPU 109 proceeds with the process to STEP S10. In the process of STEP S10, the CPU 109 judges which one of the patterns 1 to 4 has been specified for the folding pattern (STEP S10). In this process, the CPU 109 judges, from the pattern information included in the setting information, which one of the patterns 1 to 4 has been specified by the user.

As described above, in a case where the sheet on which the simplex printing has been performed is fed to the folding unit 250 or the saddle unit 300, the image forming apparatus 200 feeds the sheet in a state where the printed surface faces downward (face down). That is, in the image forming system 1, in a case where the sheet on which the simplex printing was performed has been fed to the folding unit 250 or the saddle unit 300 and has been folded inwardly in three, deliverables, in which the printed surface is visible in the state of being folded inwardly in three, in other words, the printed surface is positioned to the outside of the sheet, are generated. In a case where the CPU 109 judges that the pattern 1 or 2, in which the printed surface is positioned to the outside of the sheet, is specified, the CPU 109 proceeds with the process to STEP S12 by skipping the process of STEP S11.

On the other hand, in a case where the CPU 109 judges that the pattern 3 or 4, in which the printed surface becomes invisible in the state of being folded inwardly in three, in other words, the printed surface is positioned to the inside of the sheet, is specified, the CPU 109 proceeds with the process to STEP S11 so as to invert the printed surface upside down.

In a case where it is judged in the process of STEP S10 that the pattern 3 or 4 is specified, the CPU 109 sets the printed surface to the back surface (STEP S11). In this process, so as to invert the printed surface of the sheet on which the simplex printing has been performed, the CPU 109 sets such that the inversion of the printed surface of the sheet is performed by utilizing a conveyance path used in a case of the duplex printing. In particular, after the image has been formed on the first surface Sa of the sheet S in the printer unit 213, the CPU 109 sets such that the conveyance path is switched to conveyance path P3 by the flapper 326.

The sheet S, on whose first surface Sa the image has been formed, passes through the secondary transfer portion 320 and the fixing unit 321 from the conveyance path P3 via the duplex printing conveyance path P4, and is conveyed to the conveyance path P1 switched by the flapper 326. Then, the sheet S is conveyed to a position adjacent to the discharge port 322, is switchbacked after the conveyance path has been switched by the flapper 325, and is fed from the sheet discharge port 323 to the sheet feed port 251, so that the sheet S is fed to the folding unit 250 in a state where the first surface Sa faces upward.

To be noted, in a case where the duplex printing is specified in the setting information, the CPU 109 controls the image forming apparatus 200 such that, by performing the process of STEP S11, the image forming apparatus 200 starts to form the image from a surface which is positioned to the inside of the sheet to be folded inwardly in three.

In the process of STEP S12, the CPU 109 performs the printing by the image forming apparatus 200 (STEP S12). In this process, the CPU 109 performs image formation on the sheet based on the orientation of the image formed on the sheet and the printed surface, which have been established by the processes performed before STEP S11.

Next, the CPU 109 notifies the folding unit 250 whether or not the folding process is performed (STEP S13). In this process, in a case where the inward tri-folding by the folding unit 250 is specified by the unit information, the CPU 109 notifies the folding unit 250 that there is the folding process. In a case where it has been notified that there is the folding process, the folding unit 250 performs the inward tri-folding of the sheet, and discharge the sheet to the sheet discharge portion 258.

On the other hand, in a case where the inward tri-folding by the folding unit 250 is not specified by the unit information, the CPU 109 notifies the folding unit 250 that there is not the folding process. In a case where the folding unit 250 has been notified that there is not the folding process, the folding unit 250 discharges the sheet to the saddle unit 300 without performing the folding process on the sheet.

Next, the CPU 109 notifies the saddle unit 300 whether or not the folding process is performed (STEP S14), and ends the image forming process which is performed in a case where the sheet is folded inwardly in three. In this process, in a case where the inward tri-folding by the saddle unit 300 is specified by the unit information, the CPU 109 notifies the saddle unit 300 that there is the folding process. In a case where the saddle unit 300 has been notified that there is the folding process, the saddle unit 300 performs the inward tri-folding, and then discharges the sheet to the sheet discharge tray 332.

On the other hand, in a case where the inward tri-folding by the saddle unit 300 is not specified by the unit information, the CPU 109 notifies the saddle unit 300 that there is not the folding process. In a case where the saddle unit 300 has been notified that there is not the folding process, in a case where other post processing is also not specified, the saddle unit 300 discharges the sheet to the sheet discharge tray 330 without performing the folding process on the sheet. In a case where the execution of the post processing such as the stapling process is specified, the saddle unit 300 performs the specified post processing on the sheet, and then discharges the sheet to the sheet discharge tray 331*a*.

A mode in which the process is proceeded from this STEP S6 or S8 to STEP S10 configures a first mode in the first embodiment, and a direction which is the same as the orientation of the image data read from the document configures a first direction in the first embodiment. Further, a mode in which the process is proceeded from STEP S6 or S8 to STEP S7 or S9 configures a second mode in the first embodiment, and a direction which is inverted from the orientation of the image data read from the document configures a second direction in the first embodiment. Further, the CPU 109 which selects whether to perform the first mode or the second mode from the unit information and the pattern information, in other words, which can selectively perform the first mode and the second mode, configures a control unit in the first embodiment.

Summary of First Embodiment

As described above, the image forming apparatus 200 of the first embodiment controls the orientation of the image formed on the sheet based on the unit information specifying either the folding unit 250 or the saddle unit 300 and the pattern information specifying one of the patterns 1 to 4. In a case where the inward tri-folding by the folding unit 250 has been specified and the pattern 1 or 3 has been specified, the image forming apparatus 200 selects the execution of the first mode which controls the orientation of the image formed on the sheet in the same direction as the orientation of the image data. Further, in a case where the inward tri-folding by the saddle unit 300 has been specified and the pattern 2 or 4 has been specified, the image forming apparatus 200 selects the execution of the first mode which controls the orientation of the image formed on the sheet in the same direction as the orientation of the image data.

On the other hand, in a case where the inward tri-folding by the folding unit 250 has been specified and the pattern 2 or 4 has been specified, the image forming apparatus 200 selects the execution of the second mode which controls the orientation of the image formed on the sheet in a direction inverted from the orientation of the image data. Further, in a case where the inward tri-folding by the saddle unit 300 has been specified and the pattern 1 or 3 has been specified, the image forming apparatus 200 selects the execution of the second mode which controls the orientation of the image formed on the sheet in the direction inverted from the orientation of the image data.

Thereby, regardless of a folding pattern of the sheet in the units which are connected, the image forming apparatus 200 can generate the deliverables in accordance with a pattern which is input from the operation unit 104, and can generate the deliverables desired by the user.

Second Embodiment

Next, an image forming system 1 of a second embodiment will be described. The image forming system 1 of the second embodiment obtains the information of sequence (sequence information) in which the sheet is folded in the unit performing the inward tri-folding, and judges, depending on the obtained sequence information, whether or not to invert the image data. At this point, the image forming system 1 of the second embodiment is different from the first embodiment described above. Since other configurations are similar to the first embodiment, descriptions of constituent elements or control processes common to the first embodiment will be omitted herein by putting the same reference characters or the same step numbers.

Image Forming Process in Case of Performing Inward Tri-Folding

Figure 9:
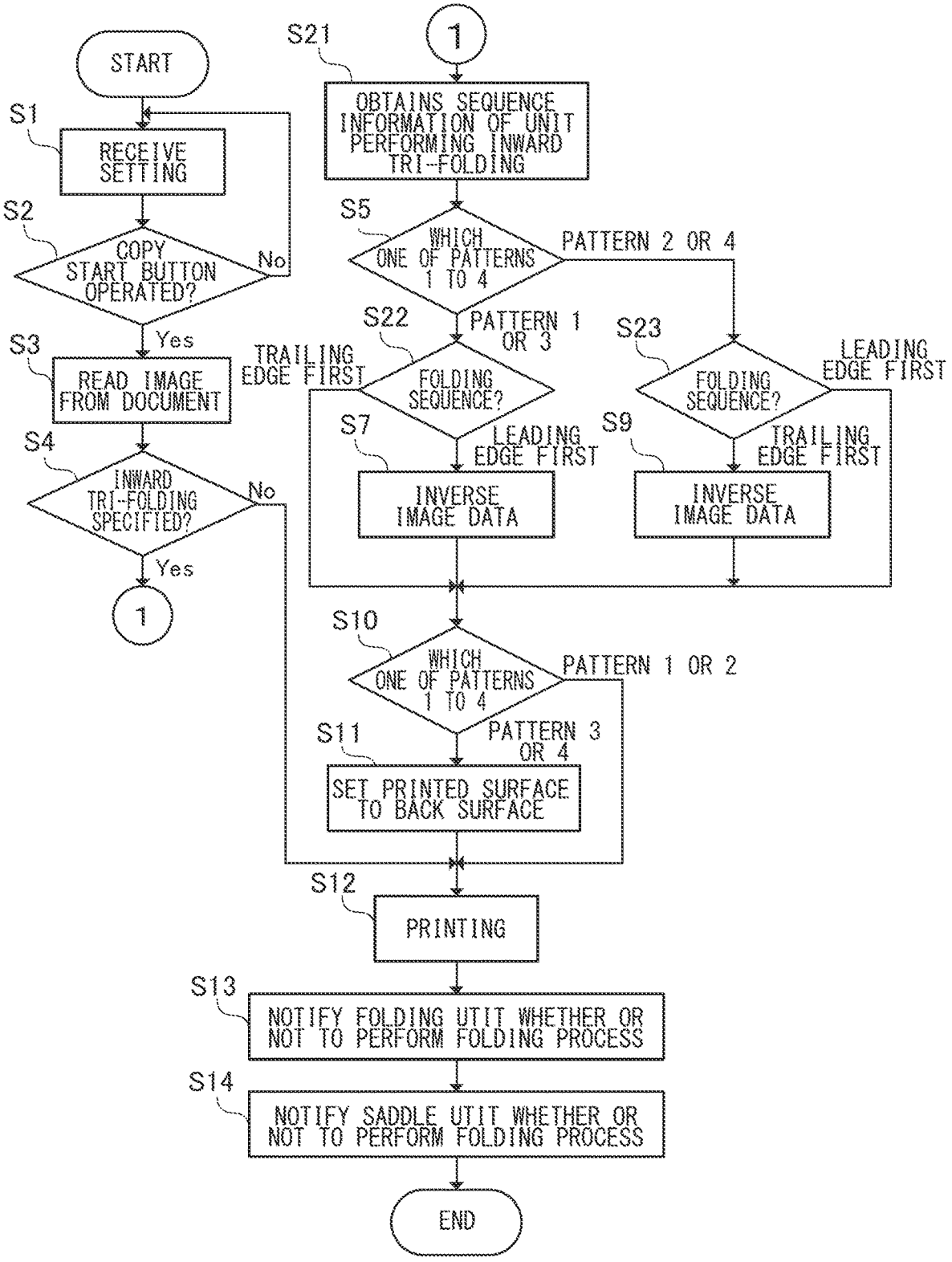
FIG. 9 is a flowchart illustrating an image forming process executed in a case where the inward tri-folding is performed in an image forming system of a second embodiment.

FIG. 9 is a flowchart illustrating an image forming process performed in a case where the CPU 109 of the controller unit 102 of the image forming apparatus 200 of the second embodiment performs the inward tri-folding on the sheet. The CPU 109 achieves the control process illustrated in FIG. 9 by executing the control program.

In a case where it is judged in the process of STEP S4 that the execution of the inward tri-folding is specified (STEP S4: YES), the CPU 109 obtains the sequence information specifying sequence for folding the sheet in the unit performing the inward tri-folding (STEP S21).

A first sequence information, in which folding sequence is specified such that the end Sc (trailing edge) on the upstream side in the sheet feeding direction C at the sheet feed port 251 is first folded along the fold line f1 and the end Sd (leading edge) on the downstream side in the sheet feeding direction C is then folded along the fold line f2, is stored in the folding unit 250 of the second embodiment. A second sequence information, in which the folding sequence is specified such that the end Sd (leading edge) on the downstream side in the sheet feeding direction C at the sheet feed port 328 is first folded along the fold line f2 and the end Sc (trailing edge) on the upstream side in the sheet feeding direction C is then folded along the fold line f1, is stored in the saddle unit 300.

The CPU 109 obtains the sequence information stored in the unit, which is specified by the unit information in the setting information, in the process of STEP S21, and proceeds with the process to STEP S5. In particular, in a case where the inward tri-folding in the folding unit 250 is specified by the unit information, the CPU 109 obtains the first sequence information for first folding the trailing edge of the sheet from the folding unit 250. Further, in a case where the inward tri-folding by the saddle unit 300 is specified by the unit information, the CPU 109 obtains the second sequence information for first folding the leading edge of the sheet from the saddle unit 300.

In a case where it is judged in the process of STEP S5 that the pattern 1 or 3 is specified, the CPU 109 judges the folding sequence of the sheet from the obtained sequence information (STEP S22). In this process, the CPU 109 judges, from the sequence information obtained in STEP S21, whether the leading edge or the trailing edge of the sheet is first folded.

As illustrated in FIG. 6A, in a case where the image forming apparatus 200 forms the image without converting the image data, the image forming apparatus 200 forms the image 601 on the upper side in the area A1 between the end Sc on the upstream side in the sheet feeding direction at the sheet feed port 251 of the folding unit 250 and the fold line f1. Further, the image forming apparatus 200 forms the image 603 on the lower side in the area A3 between the end Sd on the downstream side in the sheet feeding direction at the sheet feed port 251 of the folding unit 250 and the fold line f2. Then, the folding unit 250 performs the inward tri-folding by first folding the end Sc on the trailing edge side along the fold line f1 and then folding the end Sd on the leading edge side along the fold line f2.

That is, in a case where the pattern 1 or 3 is specified and the inward tri-folding is performed in the folding unit 250, the image forming system 1 can generate the deliverables, desired by the user, by forming the image on the sheet without converting the image data.

In a case where the obtained sequence information is the first sequence information, since it is judged that the sheet is first folded from the trailing edge side, the CPU 109 judges from the first sequence information that it is possible to generate the deliverables, desired by the user, by directly outputting the read image data without conversion. Therefore, the CPU 109 proceeds with the process to STEP S10 by skipping the process of STEP S7.

On the other hand, in a case where the image forming apparatus 200 forms the image without converting the image data, the image forming apparatus 200 forms the image 601 on the upper side in the area A1 between the end Sc on the upstream side in the sheet feeding direction at the sheet feed port 328 of the saddle unit 300 and the fold line f1. Further, the image forming apparatus 200 forms the image 603 on the lower side in the area A3 between the end Sd on the downstream side in the sheet feeding direction at the sheet feed port 328 of the saddle unit 300 and the fold line f2.

As described above, the saddle unit 300 performs the inward tri-folding by first folding the end Sd on the leading edge side along the fold line f2 and then folding the end Sc on the trailing edge side along the fold line f1. Therefore, in a case where the pattern 1 or 3 is specified and the inward tri-folding is performed in the saddle unit 300, the image forming apparatus 200 can generate the deliverables, desired by the user, by inverting the image data as illustrated in FIG. 6B and then forming the image on the sheet.

In a case where the obtained sequence information is the second sequence information, since it is judged that the sheet is first folded from the leading edge side, the CPU 109 judges, from the second sequence information, that it is possible to generate the deliverables, desired by the user, by inverting and then outputting the read image data. Therefore, the CPU 109 proceeds with the process to STEP S7.

In a case where it is judged in the process of STEP S5 that the pattern 2 or 4 is specified, the CPU 109 judges the folding sequence of the sheet from the obtained sequence information (STEP S23). In this process, the CPU 109 judges, from the sequence information obtained in STEP S21, whether the leading edge or the trailing edge of the sheet is first folded.

As illustrated in FIG. 6A, in a case where the pattern 2 or 4 is specified and the inward tri-folding is performed in the saddle unit 300, the image forming system 1 can generate the deliverables, desired by the user, by forming the image on the sheet without converting the image data.

In a case where the obtained sequence information is the second sequence information, since it is judged that the sheet is first folded from the leading edge side, the CPU 109 judges, from the second sequence information, that it is possible to generate the deliverables, desired by the user, by directly outputting the read image data without conversion. Therefore, the CPU 109 proceeds with the process to STEP S10 by skipping the process of STEP S9.

On the other hand, in a case where the pattern 2 or 4 is specified and the inward tri-folding is performed in the folding unit 250, the image forming apparatus 200 can generate the deliverables, desired by the user, by inverting the image data as illustrated in FIG. 6B and then forming the image on the sheet.

In a case where the obtained sequence information is the first sequence information, since it is judged that the sheet is first folded from the trailing edge side, the CPU 109 judges, from the first sequence information, that it is possible to generate the deliverables, desired by the user, by inverting and then outputting the read image data. Therefore, the CPU 109 proceeds with the process to STEP S9.

Summary of Second Embodiment

As described above, the image forming apparatus 200 of the second embodiment controls the orientation of the image formed on the sheet by using the unit information, the pattern information, and the sequence information. In a case where the inward tri-folding by the folding unit 250 has been specified and the pattern 1 or 3 has been specified, by the first sequence information obtained from the folding unit 250, the image forming apparatus 200 controls the orientation of the image formed on the sheet in the same direction as the orientation of the image data. Further, in a case where the inward tri-folding by the saddle unit 300 has been specified and the pattern 2 or 4 has been specified, by the second sequence information obtained from the saddle unit 300, the image forming apparatus 200 controls the orientation of the image formed on the sheet in the same direction as the orientation of the image data.

On the other hand, in a case where the inward tri-folding by the folding unit 250 has been specified and the pattern 2 or 4 has been specified, by the first sequence information obtained from the folding unit 250, the image forming apparatus 200 controls the orientation of the image formed on the sheet in the direction inverted from the orientation of the image data. Further, in a case where the inward tri-folding by the saddle unit 300 has been specified and the pattern 1 or 3 has been specified, by the second sequence information obtained from the saddle unit 300, the image forming apparatus 200 controls the orientation of the image formed on the sheet in the direction inverted from the orientation of the image data.

Thereby, regardless of the folding patterns of the sheet in the units which are connected, the image forming apparatus 200 can generate the deliverables in accordance with a pattern which has been input from the operation unit 104, and can generate the deliverables desired by the user. Further, even in a case where the image forming apparatus 200 does not possess the information of the sequence for folding the sheet in a unit, which is connected, the image forming apparatus 200 can obtain the sequence information from the unit, which is connected, and appropriately select the orientation of the image formed on the sheet, so that the image forming apparatus 200 can generate the deliverables desired by the user.

Other Embodiments

To be noted, while, in the first and second embodiment, the image forming system 1 is configured such that the folding unit 250 is connected to the image forming apparatus 200 and the saddle unit 300 is connected to the folding unit 250, it is not limited to this. It is acceptable if the image forming system 1 is configured such that the image forming apparatus 200 can be connected to the folding unit 250 and the saddle unit 300, and this disclosure can be applied to a case where either one of the folding unit 250 and the saddle unit 300 is connected to the image forming apparatus 200.

It is acceptable if, in both cases where the folding unit 250 is connected to the image forming apparatus 200 and the saddle unit 300 is connected to the image forming apparatus 200, the image forming apparatus 200 can selectively perform the first mode and the second mode based on which one of the units is specified to perform the folding process and which one of the patterns is specified.

With the configuration described above, in a case where any unit possessed by the user is connected to the image forming apparatus 200, the image forming apparatus 200 can control the orientation of the image formed on the sheet so as to generate the deliverables, desired by the user, regardless of the folding pattern of the sheet in the unit which is connected.

Further, while, in the first and second embodiment, the CPU 109 controls the orientation of the image formed on the sheet in the cases of the inward tri-folding by the folding unit 250 and the inward tri-folding by the saddle unit 300, it is not limited to this. For example, it is acceptable to configure the CPU 109 such that, in cases where the folding unit 250 performs bi-folding and the saddle unit 300 performs the bi-folding, the CPU 109 controls the orientation of the image formed on the sheet depending on the folding patterns of the sheet in the units.

Further, while, in the second embodiment, the CPU 109 is configured to obtain, as the sequence information, the information of whether the leading edge or the trailing edge of the sheet is first folded, it is not limited to this. It is acceptable if the CPU 109 is configured to obtain the information which distinguishes between the folding patterns of the folding unit 250 and the saddle unit 300, and specific details of the obtained information are not limited to the second embodiment.

Further, while, in the first and second embodiment, in a case of executing the second mode, the image forming apparatus 200 is configured to invert the orientation of the image formed on the sheet by inverting the image data, it is not limited to this. For example, it is acceptable that, in the case of executing the second mode, the image forming apparatus 200 inverts the orientation of the image on the sheet by rotating the sheet by 180 degrees with respect to the center point of the longitudinal direction and the short direction after the image has been formed on the sheet without converting the image data. In a case of such a configuration, it is acceptable to configure the image forming apparatus 200 such that the orientation of the sheet is rotatable by 180 degrees before discharging to the unit which performs the inward tri-folding.

Further, while, in the first and second embodiment, in a case of feeding the sheet to the saddle unit 300, the image forming system 1 inverts the printed surface of the sheet S by utilizing the conveyance path used in the case of performing the duplex printing, it is not limited to this. For example, it is acceptable to configure the image forming system 1 such that the printed surface of the sheet S is inverted, not by switching the conveyance path by the flapper 325, switchbacking the sheet S at the sheet discharge port 322, and conveying the sheet S to the discharge port 323, but by directly conveying the sheet S from the conveyance path P1 to the discharge port 323. Further, it is acceptable to configure the image forming system 1 such that, for example, the printed surface of the sheet S is inverted by switchbacking the sheet S after the sheet S has been conveyed to a position adjacent to the sheet discharge port 331, and then conveying the sheet S to the conveyance path P10 which has been switched by the flapper 329.

That is, it is acceptable to configure the image forming system 1 such that the printed surface of the sheet S is inverted by using configurations disposed in the printer unit 213 and the saddle unit 300 so as to enable the switchbacking and the duplex printing.

Further, while, in the first and second embodiment, the operation unit 104, serving as the input unit, is included in the image forming system 1, it is not limited. It is acceptable if the image forming system 1 includes a computer, serving as the input unit, connected to the controller unit 102 via a local area network (LAN).

Further, while, in the first and second embodiment, the folding unit 250 and the saddle unit 300 respectively serve as the first sheet folding unit and the second sheet folding unit, it is not limited to this. It is acceptable that the folding unit 250 and the saddle unit 300 respectively serve as the second sheet folding unit and the first sheet folding unit in the image forming system 1.

Embodiment(s) of the present invention can also be realized by a computer of a system or apparatus that reads out and executes computer executable instructions (e.g., one or more programs) recorded on a storage medium (which may also be referred to more fully as 'a non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-202333, filed Dec. 14, 2021, which is hereby incorporated by reference herein in its entirety.

What is claimed is:

1. An image forming apparatus being capable of connecting with a first sheet folding unit and a second sheet folding unit, the first sheet folding unit being configured to fold a sheet discharged from the image forming apparatus at a folding position between a middle of the sheet and a first end of the sheet in a sheet discharge direction and then fold the sheet at a folding position between the middle of the sheet and a second end of the sheet opposite to the first end in the sheet discharge direction, the second sheet folding unit being configured to fold a sheet discharged from the image forming apparatus at the folding position between the middle of the sheet and the second end and then fold the sheet at the folding position between the middle of the sheet and the first end, the image forming apparatus comprising:

an image forming unit configured to form an image on the sheet in accordance with image data;

an input unit configured to receive input of folding unit information specifying either one of the first sheet folding unit and the second sheet folding unit; and a control unit configured to selectively perform a first mode and a second mode based on the folding unit information, the first mode being a mode in which the image forming unit forms the image on the sheet such that an orientation of the image becomes a first direction, the second mode being a mode in which the image forming unit forms the image on the sheet such that the orientation of the image becomes a second direction inverted from the first direction.

2. The image forming apparatus according to claim 1, wherein the first sheet folding unit is configured to perform first inward tri-folding of folding the sheet at the folding position between the middle of the sheet and the first end and then folding the sheet at the folding position between the middle of the sheet and the second end so as to position a first surface of the sheet to an inside, and wherein the second sheet folding unit is configured to perform second inward tri-folding of folding the sheet at the folding position between the middle of the sheet and the second end and then folding the sheet at the folding position between the middle of the sheet and the first end so as to position the first surface of the sheet to an inside.

3. The image forming apparatus according to claim 2, wherein, by being folded inwardly in three, the sheet on which the image has been formed is folded at a position between a first portion of the image which is in accordance with the image data and a second portion of the image which is in accordance with the image data, and is folded at a position between the second portion and a third portion of the image which is in accordance with the image data, wherein, when the orientation of the image is the first direction, the first portion, the second portion, and the third portion are disposed in order of the first portion, the second portion, and the third portion from the first end of the sheet toward the second end, and wherein the input unit is configured to receive the input of specifying a first folding pattern and a second folding pattern, the first folding pattern being a folding pattern in which the sheet is firstly folded along a line between the first portion and the second portion, the second folding pattern being a folding pattern in which the sheet is firstly folded along a line between the second portion and the third portion.

4. The image forming apparatus according to claim 3, wherein the control unit is configured to perform the first mode in a case where the first sheet folding unit has been specified and the first folding pattern has been specified, and configured to perform the second mode in a case where the second sheet folding unit has been specified and the first folding pattern has been specified.

5. The image forming apparatus according to claim 3, wherein the control unit is configured to perform the first mode in a case where the first sheet folding unit has been specified and the first folding pattern has been specified, and configured to perform the first mode in a case where the second sheet folding unit has been specified and the second folding pattern has been specified.

6. The image forming apparatus according to claim 3, wherein the control unit is configured to perform the second mode in a case where the first sheet folding unit has been specified and the second folding pattern has been specified, and configured to perform the second mode in a case where the second sheet folding unit has been specified and the first folding pattern has been specified.

7. The image forming apparatus according to claim 3, wherein the control unit is configured to perform the second mode in a case where the first sheet folding unit has been specified and the second folding pattern has been specified, and configured to perform the first mode in a case where the second sheet folding unit has been specified and the second folding pattern has been specified.

8. The image forming apparatus according to claim 3, wherein in a case where the first sheet folding unit is connected, the control unit is configured to obtain first sequence information specifying sequence for folding an end of the sheet by the first sheet folding unit as sequence information, wherein in a case where the second sheet folding unit is connected, the control unit is configured to obtain second sequence information specifying sequence for folding the end of the sheet by the second folding unit as the sequence information, and wherein the control unit is configured to select whether to perform either the first mode or the second mode by using the folding unit information, the folding information, and the sequence information.

9. An image forming system comprising:

the image forming apparatus according to claim 1;

the first sheet folding unit configured to fold the sheet at the folding position between the middle of the sheet and the first end and then fold the sheet at the folding position between the middle of the sheet and the second end; and the second sheet folding unit configured to fold the sheet at the folding position between the middle of the sheet and the second end and then fold the sheet at the folding position between the middle of the sheet and the first end.

10. An image forming apparatus being capable of connecting with a first sheet folding unit and a second sheet folding unit, the first sheet folding unit being configured to perform a first folding process, the first folding process including a first operation for folding the sheet and a second operation in which the sheet is folded such that a portion of the sheet folded by the second operation overlaps a portion of the sheet folded by the first operation in a thickness direction of the sheet, the second sheet folding unit being configured to perform a second folding process, the second folding process including a third operation for folding the sheet and a fourth operation in which the sheet is folded such that a portion of the sheet folded by the fourth operation overlaps a portion of the sheet folded by the third operation in the thickness direction of the sheet, the image forming apparatus comprising:

an image forming unit configured to form an image on the sheet in accordance with image data;

an input unit configured to receive input of folding unit information specifying either one of the first folding process by the first sheet folding unit and the second folding process by the second sheet folding unit; and a control unit configured to control such that the image forming unit changes an orientation of the image formed on the sheet based on the folding unit information which has been input in the input unit.

11. The image forming apparatus according to claim 10, wherein a deliverable which the first sheet folding unit generates by performing the first folding process of the sheet on which the image forming unit has formed the image in an orientation of a first direction and a deliverable which the second sheet folding unit generates by performing the second folding process of the sheet on which the image forming unit has formed the image in an orientation of a second direction inverted with respect to the first direction are in a same form.

* * * * *